US007411348B2

(12) United States Patent
Park

(10) Patent No.: US 7,411,348 B2
(45) Date of Patent: Aug. 12, 2008

(54) PLASMA DISPLAY PANEL

(75) Inventor: Min Soo Park, Seoul (KR)

(73) Assignee: LG Electronics Inc., Seoul (KR)

( * ) Notice: Subject to any disclaimer, the term of this patent is extended or adjusted under 35 U.S.C. 154(b) by 247 days.

(21) Appl. No.: 11/275,150

(22) Filed: Dec. 15, 2005

(65) Prior Publication Data

US 2007/0001603 A1 Jan. 4, 2007

(30) Foreign Application Priority Data

Dec. 16, 2004 (KR) ..... 10-2004-0106907

(51) Int. Cl.
*H01J 17/49* (2006.01)

(52) U.S. Cl. ..... 313/582; 313/584; 313/586

(58) Field of Classification Search ..... 313/582–587
See application file for complete search history.

(56) References Cited

U.S. PATENT DOCUMENTS 6,400,347 B1 * 6/2002 Kang ..... 345/68
6,987,357 B2 * 1/2006 Kao et al. ..... 313/582

FOREIGN PATENT DOCUMENTS

| | | |
|---|---|---|
| JP | 2003-282011 | 10/2003 |
| KR | 10-2004-0018496 | 3/2004 |
| KR | 10-2004-0060722 | 7/2004 |

* cited by examiner

*Primary Examiner*—Vip Patel
(74) *Attorney, Agent, or Firm*—Fish & Richardson P.C.

(57) ABSTRACT

Disclosed is a plasma display panel. A plasma display panel according to an embodiment of the present invention comprises a front substrate and a rear substrate attached to each other with a predetermined distance therebetween, a plurality of barrier ribs disposed between the front and rear substrates creating a plurality of discharge cells, and a plurality of scan electrodes and a plurality of sustain electrodes which are alternately arranged in each discharge cell. The plasma display panel has the enhanced discharge efficiency and emission efficiency. Further, the plasma display panel can be manufacture at low cost.

18 Claims, 10 Drawing Sheets

PLASMA DISPLAY PANEL

This Nonprovisional application claims priority under 35 U.S.C. § 119(a) on Patent Application No. 10-2004-0106907 filed in Korea on Dec. 16, 2004, the entire contents of which are hereby incorporated by reference.

BACKGROUND OF THE INVENTION

1. Field of the Invention

The present document relates to a plasma display apparatus. More particularly, the present document relates to the structure of a plasma display panel of the plasma display apparatus.

2. Description of the Background Art

Generally, a plasma display panel comprises a front substrate and a rear substrate. Barrier ribs formed between the front substrate and the rear substrate define discharge cells. An inert gas, such as neon (Ne) and helium (He), or an inert gas mixture (Ne+He) of neon (Ne) and helium (He) is injected into the discharge cells. When the gas is discharged by a high frequency voltage, the inert gas generates vacuum ultra-violet rays that excite phosphors deposited between the barrier ribs so that the phosphors emit visible light rays, thereby to implement images.

FIG. 1 illustrates the structure of the related art plasma display panel.

FIG. 1 is a schematic view illustrating the structure of a plasma display panel in accordance with a related art. As shown in FIG. 1, the related art plasma display panel comprises a front panel 100 and a rear panel 110 disposed apart from each other by a distance and combined with each other. The front panel 100 comprises a front substrate 101 serving as a displaying surface, scan electrodes 102 and sustain electrodes 103, arranged on the front substrate 101. The rear panel 110 comprises a rear substrate 111 providing a rear surface of the plasma display panel and address electrodes 113 arranged on the rear substrate 111 to intersect the sustain electrode pairs.

The front panel 100 comprises a plurality of electrode pairs, each pair being comprised of the scan electrode 102 and the sustain electrode 103. Each scan electrode 102 comprises a transparent electrode 102*a* made of indium tin oxide (ITO) and a bus electrode 102*b* made of metal. Each sustain electrode 103 comprises a transparent electrode 103*a* made of ITO and a bus electrode 103*b* made of metal. The scan electrodes 102 and the sustain electrodes 103 are covered with an upper dielectric layer 104. Further, a protection layer 105 is formed on the top surface of the upper dielectric layer 104.

The rear panel 110 comprises barrier ribs 112 creating a plurality cells. The rear panel 110 further comprises the address electrodes 113 arranged in parallel with the barrier ribs 112. On the address electrodes 113 are formed red (R), green (G) and blue (B) phosphors 114. A lower dielectric layer 115 is interposed between the address electrodes 113 and the phosphors 114.

In the related art plasma display panel, ITO used as a material for the transparent electrodes 102*a* and 103*a* occupies a large portion of a material cost. On the other hand, recently technologies of the plasma display panel are focused on development of a plasma display panel that has excellent visual perception and driving characteristic and can be manufactured at low cost.

SUMMARY OF THE INVENTION

Accordingly, an object of the present invention is to solve at least the problems and disadvantages of the background art.

An object of the present invention is to provide a plasma display panel having the enhanced discharge efficiency.

Another object of the present invention is to provide a plasma display panel having the enhanced emission efficiency.

Further another object of the present invention is to provide a plasma display panel that can be manufactured at low cost.

According to an embodiment of the present invention, there is provided a plasma display panel comprising a front substrate and a rear substrate attached to each other with a predetermined distance therebetween, a plurality of barrier ribs disposed between the front substrate and the rear substrate, creating a plurality cells and a plurality of scan electrodes and sustain electrodes which are alternately arranged in a discharge cell.

According to another embodiment of the present invention, there is provided a plasma display panel comprising a front substrate and a rear substrate attached to each other with a predetermined distance therebetween, a plurality of barrier ribs disposed between the front substrate and the rear substrate creating a plurality cells and a plurality of scan electrodes and sustain electrodes which are alternately arranged in a discharge cell and are opaque electrodes.

According to further another embodiment of the present invention, there is provided a plasma display panel comprising a front substrate and a rear substrate attached to each other with a predetermined distance therebetween, a plurality of closed-type barrier ribs disposed between the front substrate and the rear substrate creating a plurality cells and a plurality of scan electrodes and sustain electrodes which are alternately arranged in a discharge cell and are opaque electrodes.

The plasma display panel according to the present invention can enhance the discharge efficiency.

The plasma display panel according to the present invention can enhance the emission efficiency.

The plasma display panel can be manufactured at the reduced manufacturing cost.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
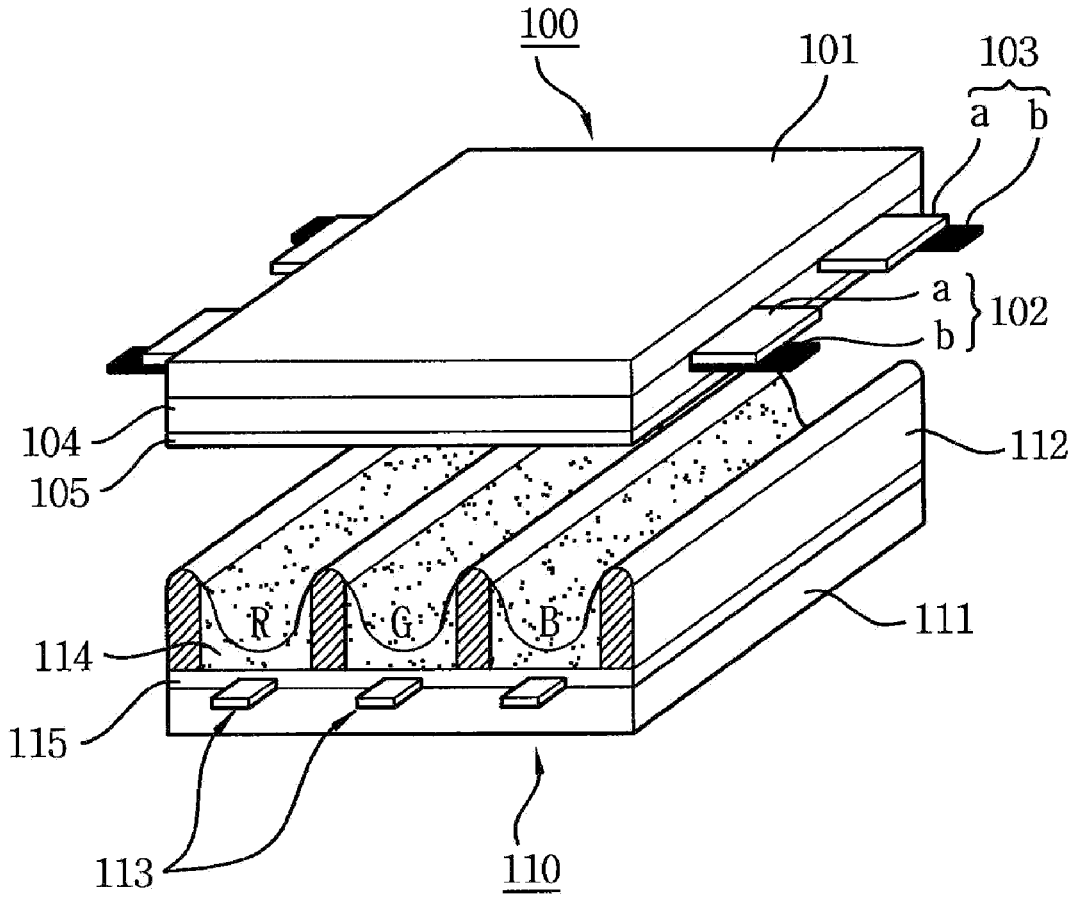
FIG. 1 illustrates the structure of a related art plasma display panel.

Preferred embodiments of the present invention will be described in a more detailed manner with reference to the drawings.

A plasma display panel according to an embodiment of the present invention comprises a front substrate and a rear substrate attached to each other with a predetermined distance therebetween, a plurality of barrier ribs disposed between the front and rear substrates creating a plurality cells and a plurality of scan electrodes and sustain electrodes which are alternately arranged in a discharge cell.

The number of scan electrodes and sustain electrodes in at least two discharge cells are different from each other.

The number of scan electrodes and sustain electrodes varies according to the size of a discharge cell.

The number of scan electrodes and sustain electrodes varies according to the width of the scan electrodes and sustain electrodes.

The width of the scan electrodes and sustain electrodes is about 30 to 70 μm.

A distance between the scan electrode and the sustain electrode at a center portion of a discharge is the same as a distance between the scan electrode and the sustain electrode at periperal porftion of the discharge cell.

A distance between the scan electrodes and sustain electrodes at peripheral portions of a discharge cell is different from a distance between the scan electrode and the sustain electrode at a center portion of the discharge cell.

The distance between the scan electrodes and sustain electrodes at the center portion of the discharge is about 30 to 60 μm.

The distance between the scan electrodes and sustain electrodes at the peripheral portion of the discharge is about 40 to 100 μm.

A plasma display panel according to another embodiment of the present invention comprises a front substrate and a rear substrate which are attached to each other with a predetermined distance therebetween, a plurality of barrier ribs disposed between the front and rear substrates creating a plurality cells, and a plurality of scan electrodes and sustain electrodes which are alternately arranged in a discharge cell and are opaque electrodes.

The opaque electrodes are metal electrodes.

The number of scan electrodes and sustain electrodes in at least two discharge cells are different from each other.

The number of scan electrodes and sustain electrodes varies according to the size of a discharge cell.

The number of scan electrodes and sustain electrodes varies according to the width of the scan electrodes and sustain electrodes.

The width of the scan electrodes and sustain electrodes is about 30 to 70 μm.

A distance between the scan electrode and the sustain electrode at a center portion of a discharge is the same as a distance between the scan electrode and the sustain electrode at periperal porftion of the discharge cell.

A distance between the scan electrodes and sustain electrodes at peripheral portions of a discharge cell is different from a distance between the scan electrode and the sustain electrode at a center portion of the discharge cell.

The distance between the scan electrodes and sustain electrodes at the center portion of the discharge is about 30 to 60 μm.

The distance between the scan electrodes and sustain electrodes at the peripheral portion of the discharge is about 40 to 100 μm.

A plasma display panel according to further another embodiment of the present invention comprises a front substrate and a rear substrate attached to each other with a predetermined distance therebetween, a plurality of closed-type barrier ribs disposed between the front and rear substrates creating a plurality cells, and a plurality of scan electrodes and sustain electrodes which are alternately arranged in a discharge cell and are opaque electrodes.

Hereinafter, an embodiment of the present invention will be described in more detail with reference to the accompanying drawings.

Figure 2:
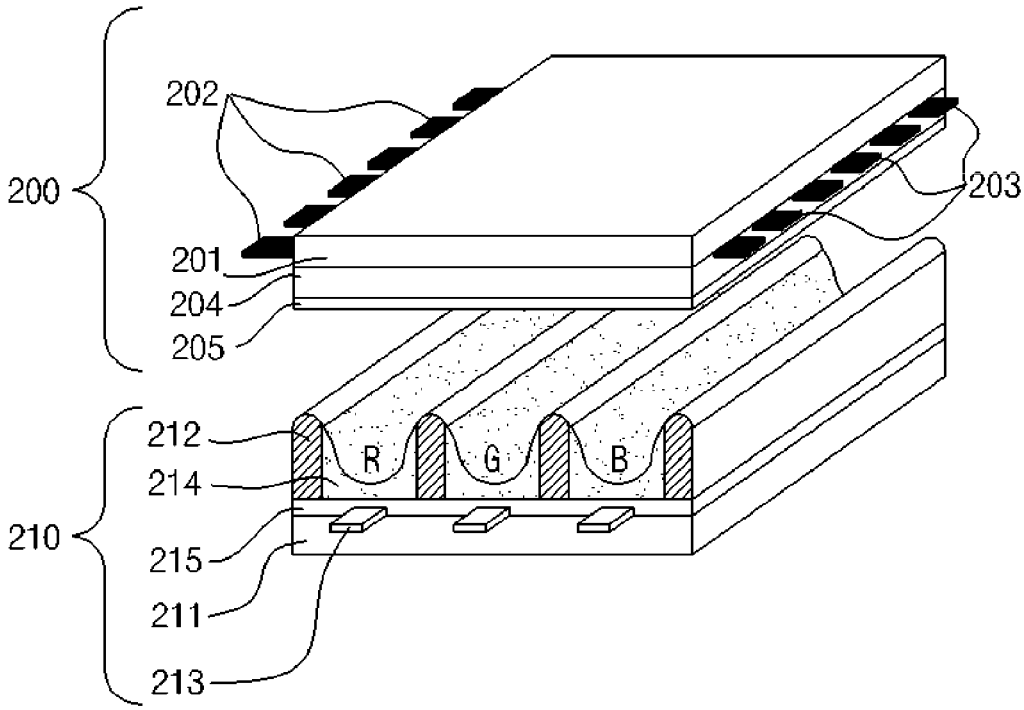
FIG. 2 illustrates the structure of a plasma display panel according to an embodiment of the present invention.

FIG. 2 illustrates the structure of a plasma display panel according to an embodiment of the present invention.

As shown in FIG. 2, the plasma display panel comprises a front substrate 201 and a rear substrate 211 combined with each other having a distance between of both, and barrier ribs 212 disposed between the front substrate 201 and the rear substrate 211 creating a plurality cells. Electrode pairs, each pair being comprised of a scan electrode 202 and a sustain electrode 203, are arranged on the front substrate 201. Address electrodes 213 are formed on the rear substrate 211 and formed to extend to intersect the scan electrodes 202 and the sustain electrodes 203.

A front panel 200 comprises the scan electrodes 202 and the sustain electrodes 203, for generating and sustaining a discharge in the discharge cell, in which one scan electrode 202 and one sustain electrode 203 make an electrode pair. The scan electrodes 202 and the sustain electrodes 203 are covered with an dielectric layer 204 which limits discharge current and insulates the electrode pairs from each other. A protective layer 205 made of magnesium oxide (MgO) is formed on the surface of the dielectric layer 204 to facilitate the discharge condition.

A rear panel 210 comprises the barrier ribs 212, which define a plurality of discharge spaces, i.e. discharge cells. The barrier ribs 212 are arranged in parallel with each other. The rear panel 210 further comprises a plurality of address electrodes 213, which generate vacuum ultraviolet rays by performing an address discharge and is arranged to intersect the scan electrodes 202 and the sustain electrodes 203. The rear panel 210 still further comprises red (R), green (G) and blue (B) phosphors 214 which emit visible light rays during the address discharge to implement images. A lower dielectric layer 215 is interposed between the address electrodes 213 and the phosphors 214 for protecting the address electrodes 213.

The structure of the scan electrodes 202 and the sustain electrodes 203 formed on the front substrate 201 will be described in more detail. A plurality of scan electrodes and sustain electrodes 202 and 203 are alternately arranged in a discharge cell. That is, the scan electrodes and sustain electrodes 202 and 203 are arranged in this order—the scan electrode 202, the sustain electrode 203, the scan electrode 202, the sustain electrode 203, and so on—in one discharge cell. Due to such electrode arrangement, discharge efficiency and emission efficiency are enhanced. Unlike the conventional electrode structure in the related art plasma display panels, the scan electrodes 202 and the sustain electrodes 203 in the plasma display panel according to the embodiment of the present invention are made of only an opaque material. For example, the scan electrodes 202 and the sustain electrodes 203 are made of silver (Ag) or copper (Cu). That is, indium tin oxide (ITO) which is generally used as a material for the scan electrodes and sustain electrodes in the related art is not used as an electrode material in the plasma display panel according to the embodiment of the present invention. Accordingly, the plasma display panel according to the embodiment of the present invention can reduce manufacturing cost. Detailed description on the electrode material will be made below with reference to FIGS. 3 to 7.

Figure 3:
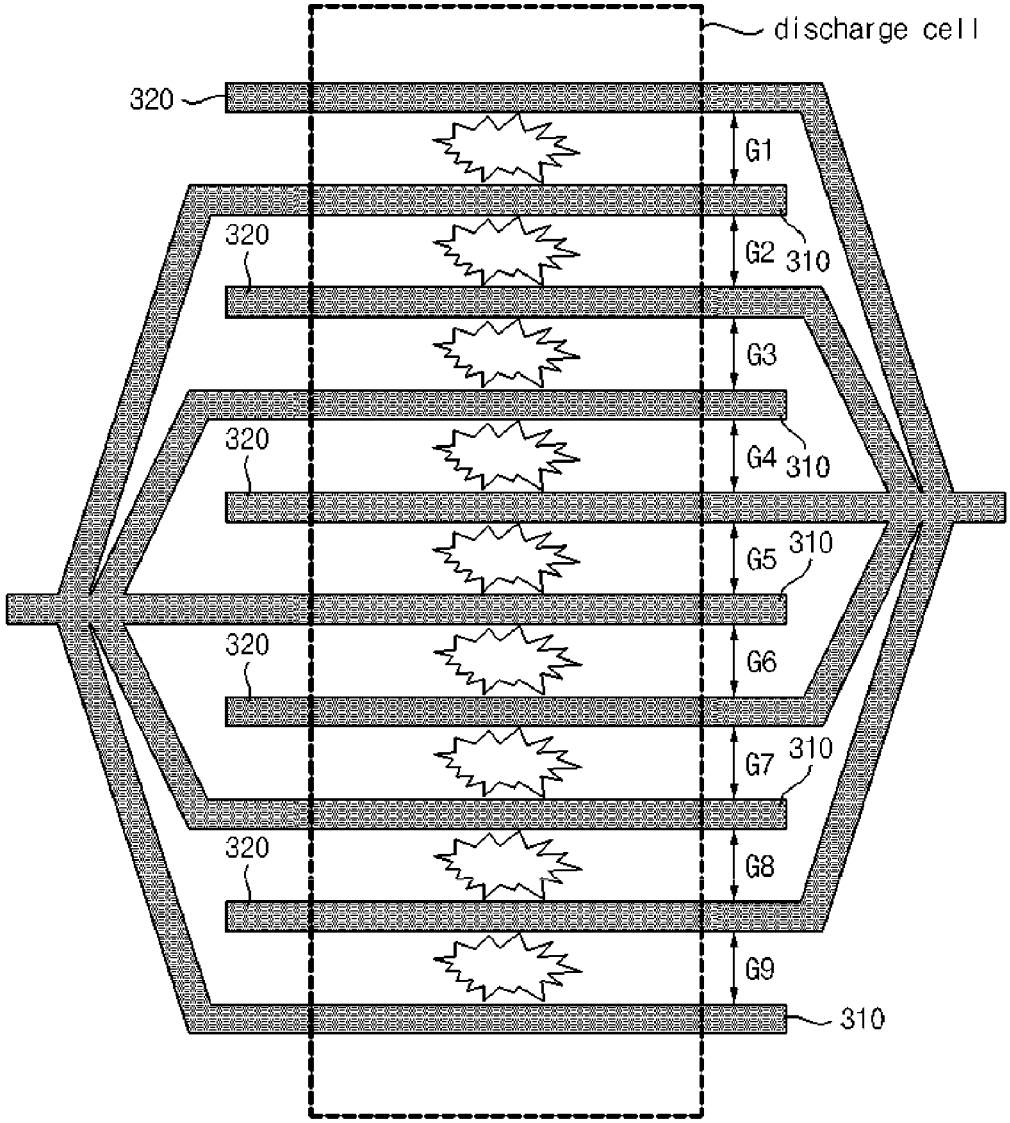
FIG. 3 illustrates the structure of electrodes in the plasma display panel according to the embodiment of the present invention.

FIG. 3 illustrates the structure of electrodes in one discharge cell in the plasma display panel shown in FIG. 2.

Here, FIG. 3 schematically illustrates only the electrode structure of the present invention plasma display panel for explaining the arrangement of the scan electrodes and sustain electrodes in one discharge cell in the plasma display panel shown in FIG. 2.

As described above, according to the embodiment of the present invention, a plurality of scan electrodes 310 and a plurality of sustain electrodes 320 are alternately arranged in a discharge cell. Further, the scan electrodes and sustain electrodes 310 and 320 are made of only an opaque material. The opaque material is a metal such as silver (Ag) or copper (Cu) which is used as a material for a bus electrode in the related art plasma display panels.

Thanks to the electrode structure described above, a mutual discharge occurs every between the scan electrodes and sustain electrodes when the plasma display panel is driven. Accordingly, the discharge intensity is uniform all over the entire discharge area in which the discharge cells are disposed. That is, it is possible to increase the brightness of the discharge area as a whole by enhancing the discharge intensity at the peripheral portions of the discharge cells because generally the peripheral portions of the discharge cells have small discharge intensity.

By such configuration, it is possible to supplement the brightness of emission light intercepted by the opaque electrodes and thus the plasma display panel according to the embodiment of the present invention can emit light having the same as or brighter than that from the related art plasma display panels. That is, even though the scan electrodes and sustain electrodes are made of the opaque material, the brightness of the plasma display panel according to the embodiment of the present invention is not degraded.

Further, since the scan electrodes 310 and the sustain electrodes 320 are closer to each other in comparison with the conventional scan electrodes and sustain electrodes in the related art plasma display panels, a firing potential can be lowered, so that the discharge efficiency is enhanced. Still further, since the scan electrodes and sustain electrodes are made of metal, i.e. the opaque material, the scan electrodes and sustain electrodes has low electric resistance. Accordingly, it is possible to reduce power consumption of the plasma display panel. Here, the firing potential is a voltage level in the status in which a discharge is started to occur as the voltage level is applied to either of the scan electrode 310 or the sustain electrode 320.

Figure 4A:
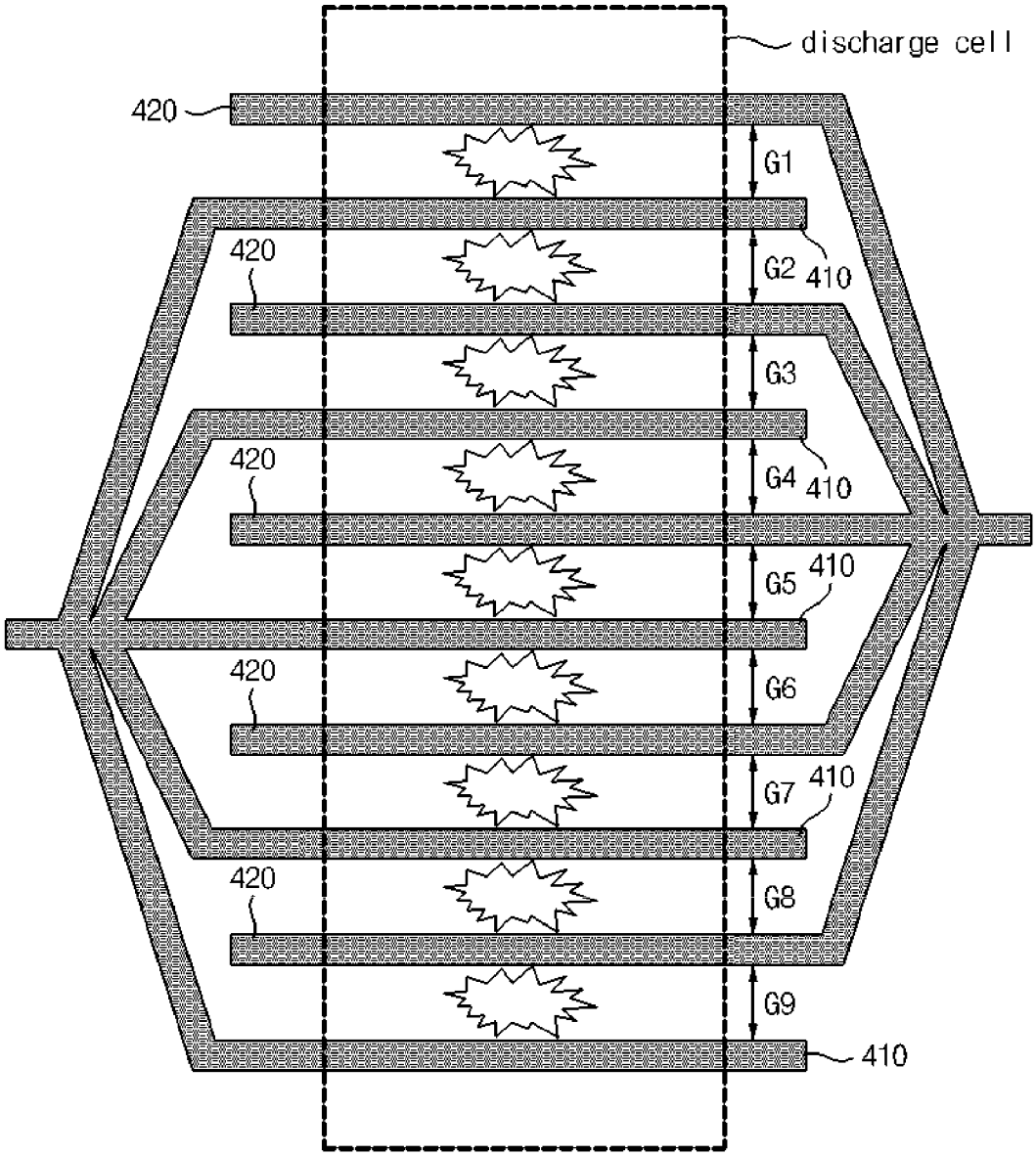
FIGS. 4A and 4B illustrate the structure of electrodes in the plasma display panel according to the embodiment of the present invention, and particularly shows the relationship between the structure of the electrodes and size of a discharge cell.
Figure 4B:
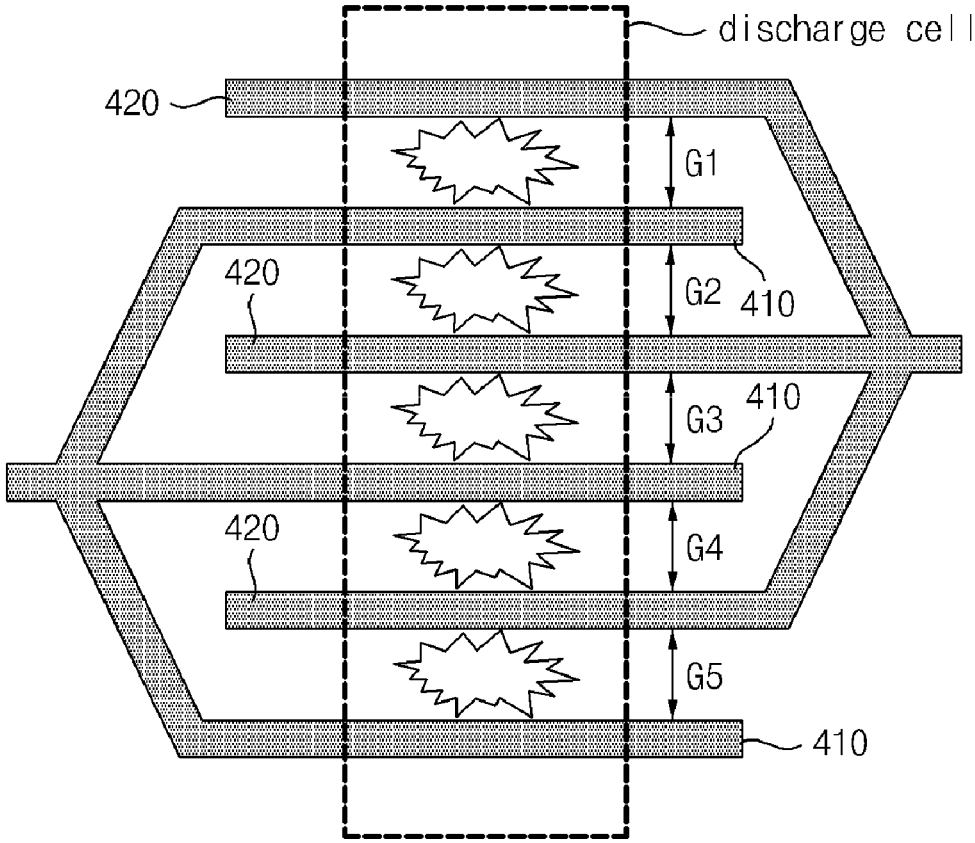

FIGS. 4A and 4B illustrate the structure of electrodes in the plasma display panel according to an embodiment of the present invention.

As shown in FIGS. 4A and 4B, the number of scan electrodes and sustain electrodes 410 and 420 varies according to size of a discharge cell. That is, as a discharge cell has a larger size, the number of scan electrodes and sustain electrodes 410 and 420 alternately arranged in the discharge cell becomes larger, thereby to increase the discharge space G1, G2, G3, G4, G5, G6, G7, G8 and G9 in which the discharge occurs. On the other hand, as shown in FIG. 4B, as a discharge cell has a smaller size, the number of scan electrodes and sustain electrodes 410 and 420 alternately arranged in the discharge cell becomes smaller, thereby to ensure the discharge space G1, G2, G3, G4 and G5 to be in proportional to the size of the discharge cell.

Figure 5A:
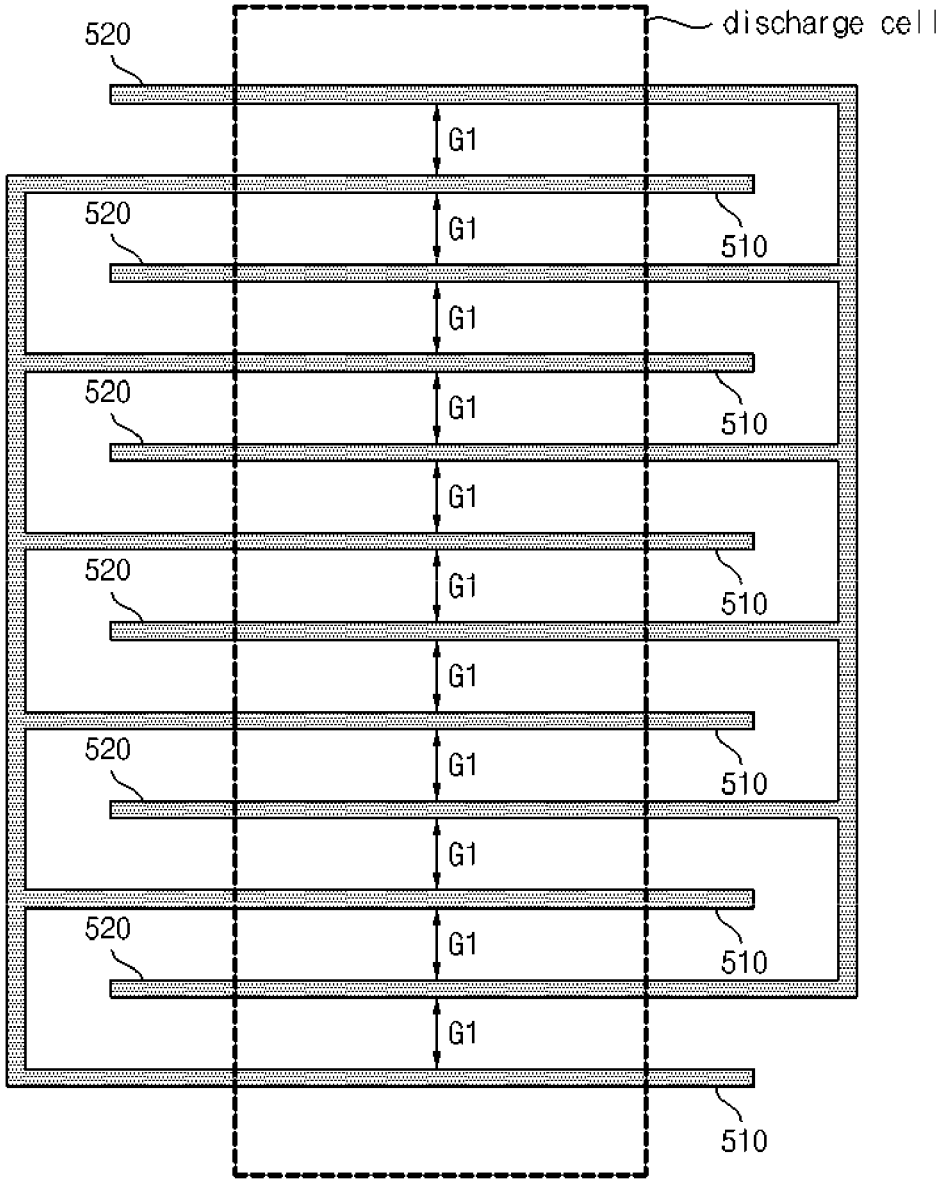
FIGS. 5A and 5B illustrate the structure of electrodes in the plasma display panel according to the embodiment of the present invention, and particularly shows the relationship between width and the structure of the electrodes.
Figure 5B:
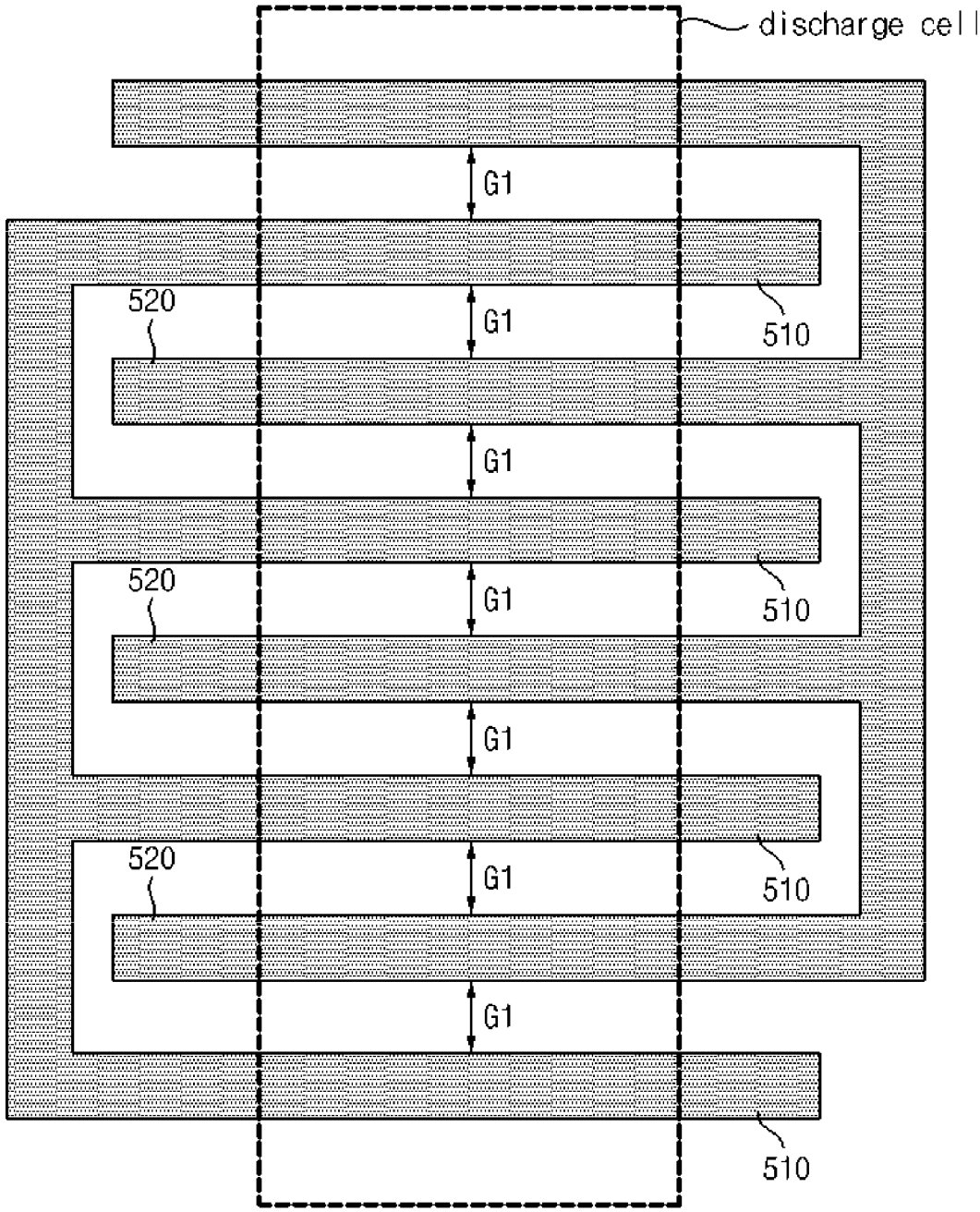

As such, according to the embodiment of the present invention, at least two discharge cells may have the different numbers of the scan electrodes and sustain electrodes arranged therein, and the number of scan electrodes and sustain electrodes is determined according to the size of the discharge cell and the width of the electrodes. Generally, size of the red (R), green (G) and blue (B) discharge cells varies according to the characteristics of phosphors, and width of the electrodes can be varied as shown in FIG. 5A and FIG. 5B. Further, according to the embodiment of the present invention, the number of scan electrodes and sustain electrodes arranged in each discharge cell can be different between at least two discharge cells.

FIG. 5A and FIG. 5B illustrates the relationship between the width and the structure of the electrodes.

Referring to FIG. 5A and FIG. 5B, the number of scan electrodes and sustain electrodes 510 and 520 arranged in each discharge cell varies according to the width of the scan electrodes and sustain electrodes 510 and 520. That is, as shown in FIG. 5A, as the width of the electrodes is smaller, the number of the electrodes in a discharge cell becomes larger. On the contrary, as the width of the electrodes is larger, the number of the electrodes in a discharge cell becomes smaller. The width of the scan electrodes and sustain electrodes is preferably 30 to 70 μm, when taking into account the optimum discharge efficiency and efficiency of the plasma display panel.

Figure 6A:
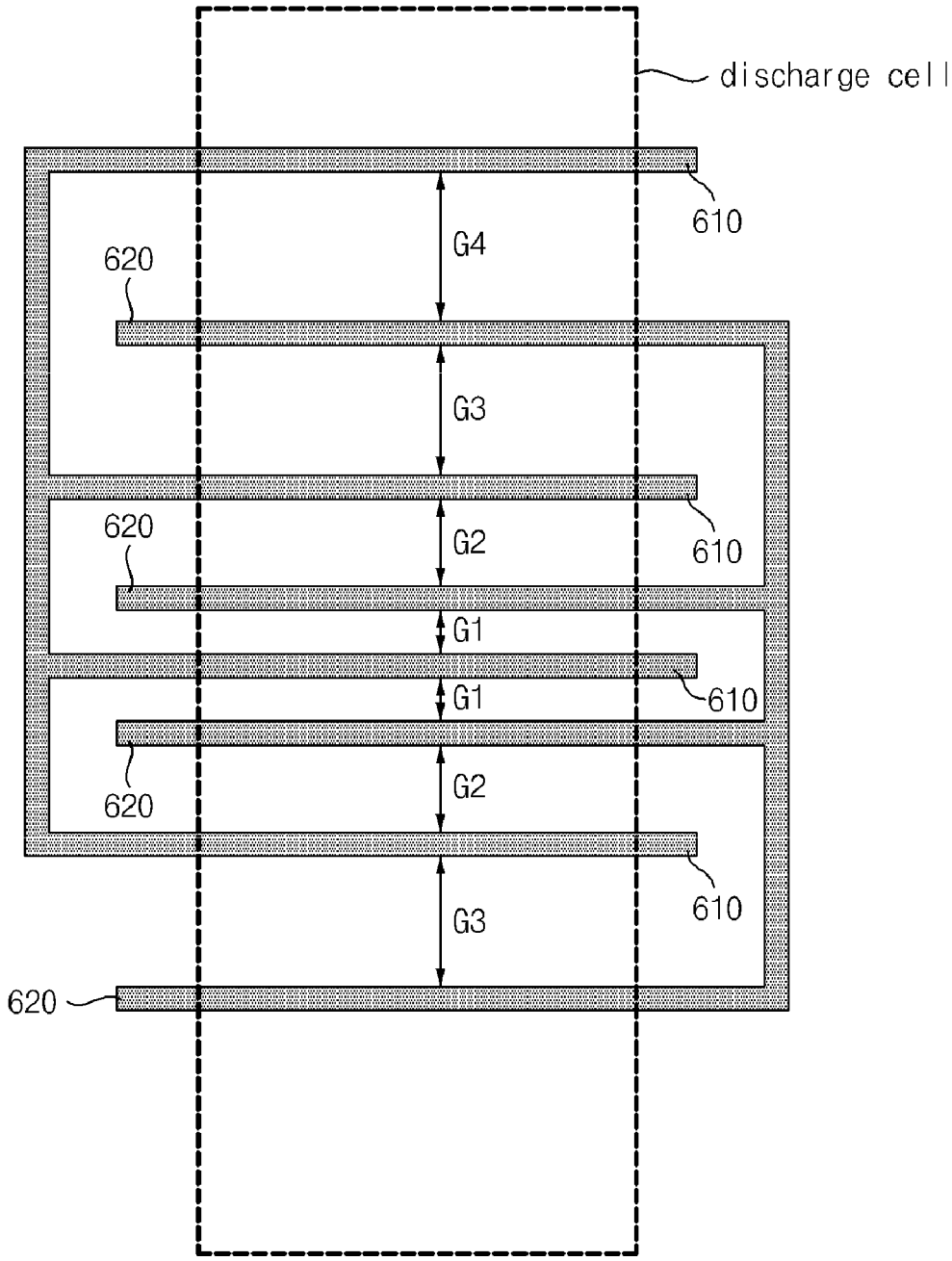
FIGS. 6A and 6B illustrate the structure of electrodes in the plasma display panel according to the embodiment of the present invention, and particularly shows the relationship between the structure of the electrodes and a distance between the electrodes.
Figure 6B:
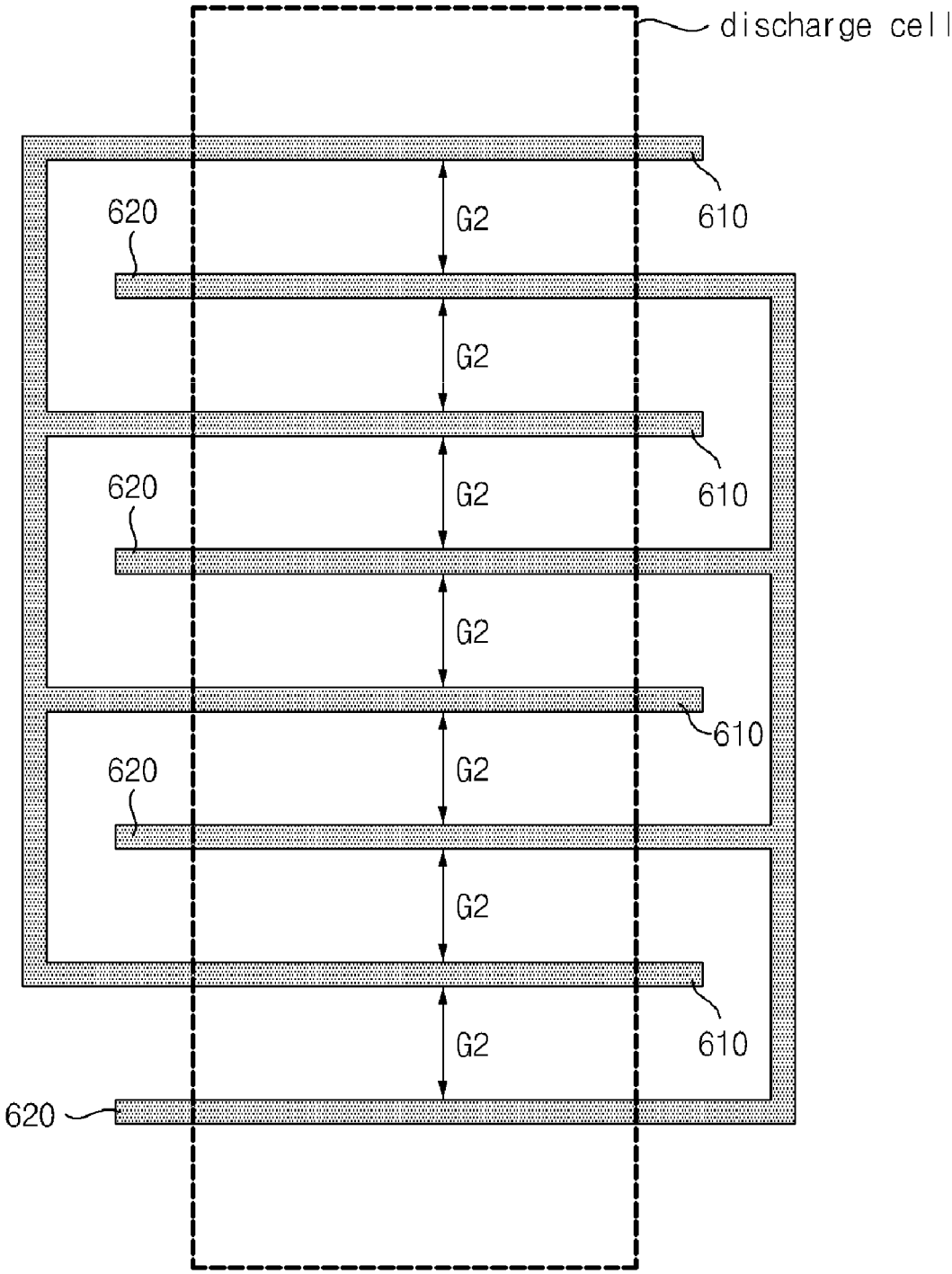

FIG. 6A and FIG. 6B illustrates the relationship between the structure of electrodes and a distance between two adjacent electrodes.

Referring to FIG. 6A, the distance between a scan electrode 610 and a sustain electrode 620 becomes larger from the center to peripheral portions of a discharge cell. That is, a discharge gap G4 is wider than a discharge gap G1. Such configuration is designed to lower a firing potential by providing a narrow discharge gap at the center portion of the discharge cell, thereby facilitating the discharge at the center portion of the discharge cell. In order to enhance the discharge efficiency, the distance, the discharge gap, between the scan electrode 610 and the sustain electrode 620 at the center portion of the discharge is determined to be in the range of 30 to 60 μm.

Further, by making the discharge gap at the peripheral portions of the discharge cell wider than that at the center portion of the discharge cell, it is possible to accelerate emission of secondary electrons, thereby capable of enhancing the emission efficiency. In order to enhance the emission efficiency, the distance between the scan electrode 610 and the sustain electrode 620 is determined to be in the range of 40 to 100 μm.

As shown in FIG. 6B, in the case in which the discharge gaps G2 at the center portion and at the peripheral portion of a discharge cell is the same, it is possible to easily form patterns of the electrodes when manufacturing the plasma display panel, and further it is possible to equalize the discharge intensity all over the entire discharge cell area, at the center portion and the peripheral portions of the discharge cell, thereby capable of preventing discharge damage from being caused to one spot in a discharge cell.

Figure 7:
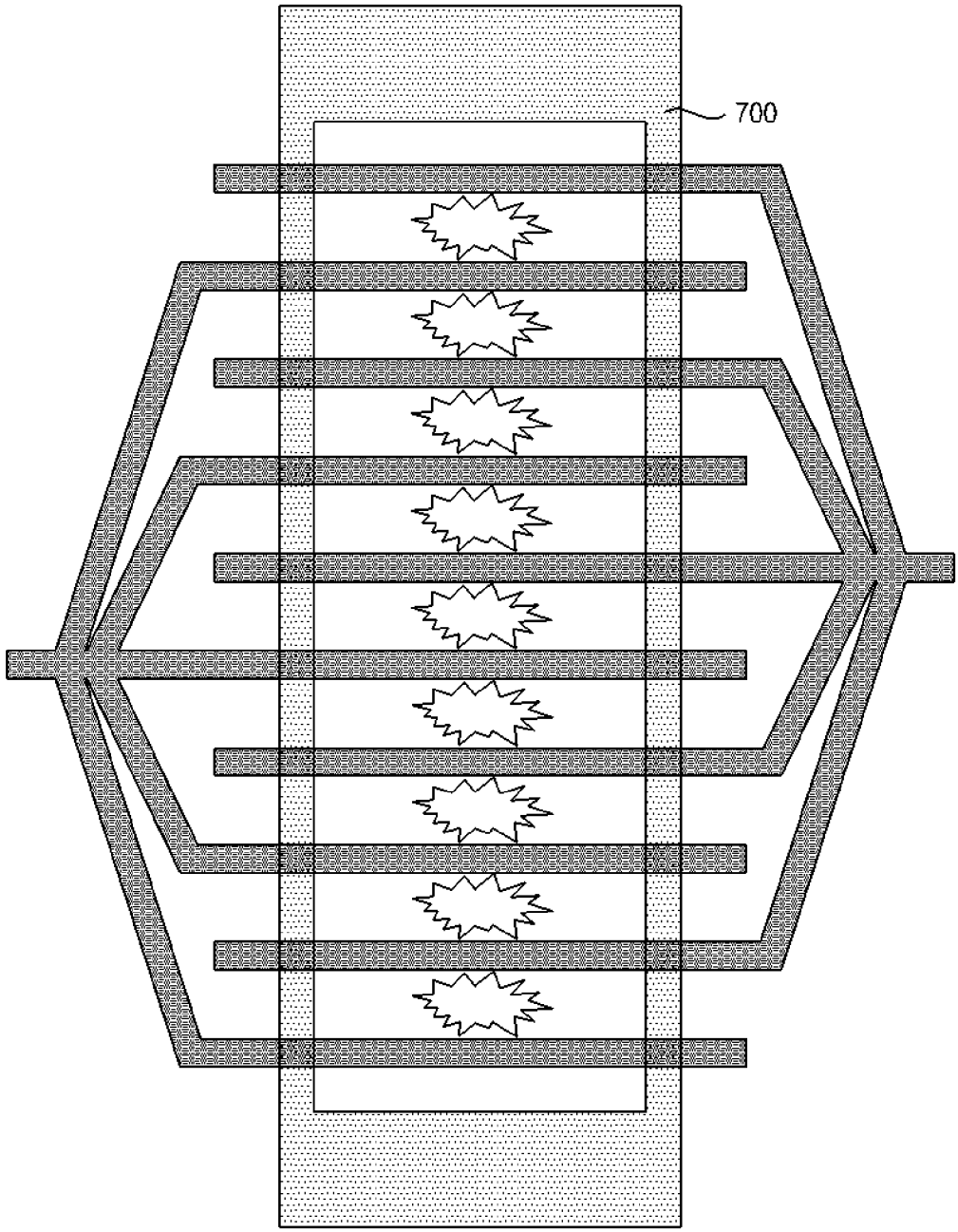
FIG. 7 is a schematic view illustrating the structure of electrodes in a discharge cell of the plasma display panel according to the embodiment of the present invention.

FIG. 7 illustrates the structure of the plasma display panel according to another embodiment of the present invention.

As shown in FIG. 7, the plasma display panel according to the embodiment of the present invention comprises closed-type barrier ribs 700. That is, according to the embodiments of the present invention, the barrier ribs can be opened-type and closed-type. However, the closed-type barrier ribs are preferably adopted to prevent erroneous discharge caused due to cross talk that can occur upon discharging. The closed-type barrier rib is the barrier rib structure by which each of the discharge cells is completely closed and adjacent discharge cells are physically completely separated. For example, a well-type discharge cell is formed by the closed-type barrier ribs. On the other hand, in case of using the opened-type barrier ribs, discharge cells are opened, that is, adjacent discharge cells are not physically completely separated. A stripe-type discharge cell is formed by the opened-type barrier ribs.

Accordingly, thanks to the electrode structure described above, the plasma display panel according to the embodiments of the present invention has the advantage in which a discharge occurs uniformly all over the whole discharge cell area unlike the related art plasma display panel in which a discharge occurs at only a center portion of a discharge cell.

The invention being thus described, it will be obvious that the same may be varied in many ways. Such variations are not to be regarded as a departure from the spirit and scope of the invention, and all such modifications as would be obvious to one skilled in the art are intended to be comprised within the scope of the following claims.

What is claimed is:

1. A plasma display panel, comprising:

a front substrate and a rear substrate attached to each other with a predetermined distance therebetween;

a plurality of barrier ribs disposed between the front and rear substrates creating a plurality of discharge cells; and a plurality of scan electrodes and a plurality of sustain electrodes which are alternately arranged in each discharge cell, wherein the numbers of scan electrodes and sustain electrodes in at least two discharge cells are different from each other.

2. The plasma display panel as claimed in claim 1, wherein the number of scan electrodes and sustain electrodes varies according to the size of a discharge cell.

3. The plasma display panel as claimed in claim 1, wherein the number of scan electrodes and sustain electrodes varies according to the width of the scan electrodes and sustain electrodes.

4. The plasma display panel as claimed in claim 1, wherein the width of the scan electrodes and sustain electrodes is about 30 to 70 μm.

5. The plasma display panel as darned in claim 1, wherein a distance between the scan electrode and the sustain electrode at a center portion of the discharge cell is the same as a distance between the scan electrode and the sustain electrode at a peripheral portion of the discharge cell.

6. The plasma display panel as claimed in claim 1, wherein a distance between the scan electrode and the sustain electrode at a center portion of the discharge cell is different from a distance between the scan electrode and the sustain electrode at a peripheral portion of the discharge cell.

7. The plasma display panel as claimed in claim 6, wherein the distance between the scan electrode and the sustain electrode at the center portion of the discharge cell is about 30 to 60 μm.

8. The plasma display panel as claimed in claim 6, wherein the distance between the scan electrode and the sustain electrode at the peripheral portion of the discharge cell is about 40 to 100 μm.

9. A plasma display panel, comprising:

a front substrate and a rear substrate attached to each other with a predetermined distance therebetween;

a plurality of barrier ribs disposed between the front and rear substrates creating a plurality of discharge cells; and a plurality of scan electrodes and a plurality of sustain electrodes which are alternately arranged in each discharge cell, wherein the plurality of scan electrodes and the plurality of sustain electrodes are opaque electrodes and the numbers of scan electrodes and sustain electrodes in at least two discharge cells are different from each other.

10. The plasma display panel as claimed in claim 9, wherein the opaque electrodes are metal electrodes.

11. The plasma display panel as claimed in claim 9, wherein the number of scan electrodes and sustain electrodes varies according to the size of a discharge cell.

12. The plasma display panel as claimed in claim 9, wherein the number of scan electrodes and sustain electrodes varies according to the width of the scan electrodes and sustain electrodes.

13. The plasma display panel as claimed in claim 9, wherein the width of the scan electrodes and sustain electrodes is about 30 to 70 μm.

14. The plasma display panel as claimed in claim 9, wherein a distance between the scan electrode and the sustain electrode at a center portion of the discharge cell is the same as a distance between the scan electrode and the sustain electrode at a peripheral portion of the discharge cell.

15. The plasma display panel as claimed in claim 9, wherein a distance between the scan electrode and the sustain electrode at a center portion of the discharge cell is different from a distance between the scan electrode and the sustain electrode at a peripheral portion of the discharge cell.

16. The plasma display panel as claimed in claim 15, wherein the distance between the scan electrode and the sustain electrode at the center portion of the discharge cell is about 30 to 60 μm.

17. The plasma display panel as claimed in claim 15, wherein the distance between the scan electrode and the sustain electrode at the peripheral portion of the discharge cell is about 40 to 100 μm.

18. A plasma display panel, comprising:

a front substrate and a rear substrate attached to each other with a predetermined distance therebetween;

a plurality of closed-type barrier ribs disposed between the front and rear substrates creating a plurality of discharge cells; and a plurality of scan electrodes and a plurality of sustain electrodes which are alternately arranged in each discharge cell, wherein the plurality of scan electrodes and the plurality of sustain electrodes are opaque electrodes and the numbers of scan electrodes and sustain electrodes in at least two discharge cells are different from each other.

* * * * *

UNITED STATES PATENT AND TRADEMARK OFFICE

CERTIFICATE OF CORRECTION

PATENT NO. : 7,411,348 B2
APPLICATION NO. : 11/275150
DATED : August 12, 2008
INVENTOR(S) : Min Soo Park It is certified that error appears in the above-identified patent and that said Letters Patent is hereby corrected as shown below:

Column 7, line 55, “darned” should be changed to --claimed--.

Signed and Sealed this

Eleventh Day of November, 2008

JON W. DUDAS
*Director of the United States Patent and Trademark Office*